US005636476A

United States Patent [19]

Eikmeier et al.

[11] Patent Number: 5,636,476

[45] Date of Patent: Jun. 10, 1997

[54] DEVICE FOR OPENING AND CLOSING A WINDOW, A DOOR, OR THE LIKE

[75] Inventors: Werner Eikmeier, Erkrath; Dietger Frick; Werner Riedel, both of Velbert, all of Germany

[73] Assignee: Wilhelm Weidtmann GmbH & Co. KG, Velbert, Germany

[21] Appl. No.: 383,936

[22] Filed: Feb. 6, 1995

[30] Foreign Application Priority Data

Mar. 4, 1994 [DE] Germany ..... 44 07 192.2
Nov. 8, 1994 [DE] Germany ..... 44 39 903.0

[51] Int. Cl.[6] ..... E05D 15/58

[52] U.S. Cl. ..... 49/260; 49/246

[58] Field of Search ..... 49/246, 247, 279, 49/281, 250, 260

[56] References Cited

U.S. PATENT DOCUMENTS

| | | | |
|---|---|---|---|
| 1,276,431 | 8/1918 | Smith | 49/260 X |
| 1,341,366 | 5/1920 | Fournier | 49/260 |
| 1,671,362 | 5/1928 | Fraser . | |
| 3,117,351 | 1/1964 | Ahlgren | 49/260 X |
| 3,605,339 | 9/1971 | Catlett et al. | 49/260 X |
| 5,289,656 | 3/1994 | Vetter | 49/250 |

FOREIGN PATENT DOCUMENTS

| | | | |
|---|---|---|---|
| 46119 | 2/1889 | Germany | 49/260 |
| 241295 | 7/1965 | Germany . | |
| 4109852 | 10/1991 | Germany . | |
| 2183723 | 6/1987 | United Kingdom . | |

*Primary Examiner*—Kenneth J. Dorner
*Assistant Examiner*—Jerry Redman
*Attorney, Agent, or Firm*—McAulay Fisher Nissen Goldberg & Kiel, LLP

[57] ABSTRACT

In a device for opening and closing a window, a casement moves between a closed and an open position with respect to a stationary frame. This is done by a longitudinally displaceable toothed rack, which effects the movement of the casement of a carrier. In order to obtain a space saving, easy to operate device. Not only is the casement moved by the toothed rack, but the casement is also moved by a moveable closing element in the frame between its latching position and unlatching position with a stationary carrier located on the frame. Both carriers are connected respectively to the toothed rack by means of an independent coupling, which is rendered effective and ineffective at an associated change-over location. These two change-over locations are arranged in a specific place in the path of longitudinal displacement of the toothed rack, respond to the associated coupling and are automatically effective.

29 Claims, 10 Drawing Sheets

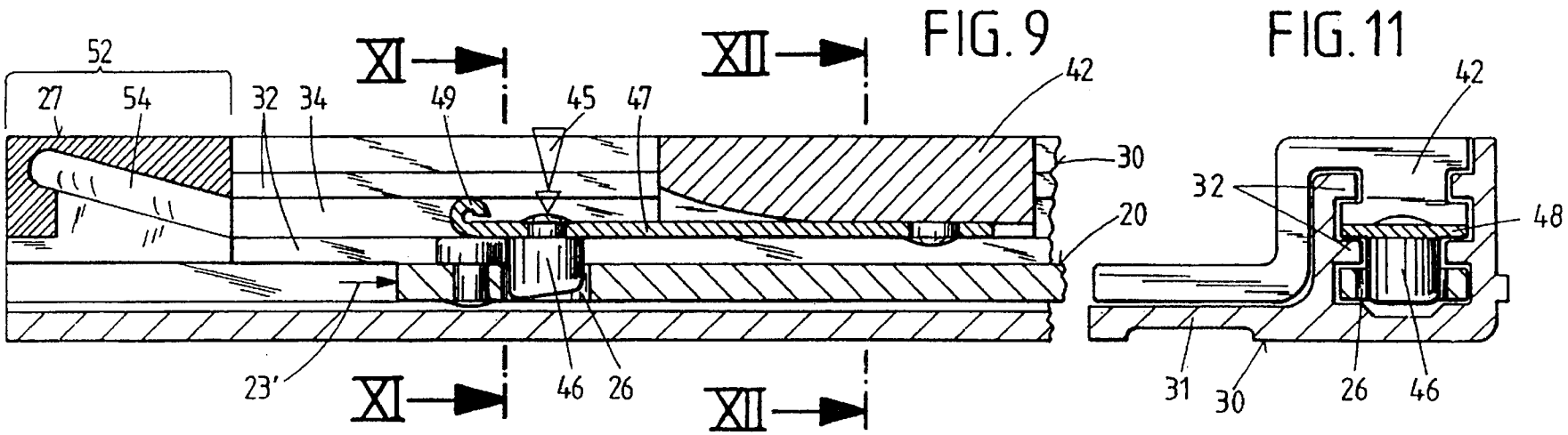
FIG. 9
42
30
20
XII
XII
47
45
26
46
49
XI
XI
34
32
23'
52
54
27
FIG. 11
42
48
46
26
32
30
31
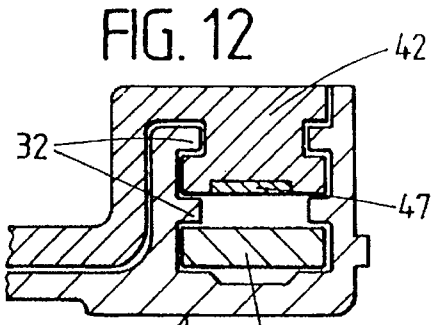
FIG. 12
42
47
20
30
32
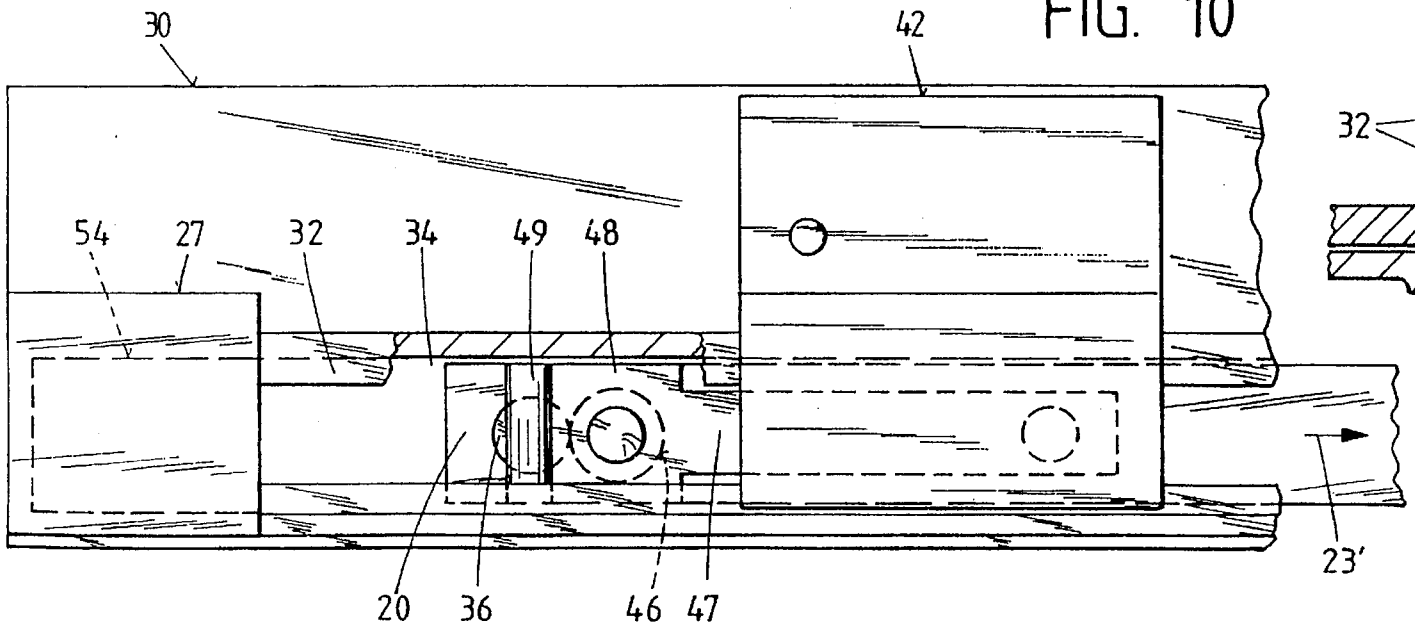
FIG. 10
23'
42
47
46
48
49
36
34
20
32
27
30
54

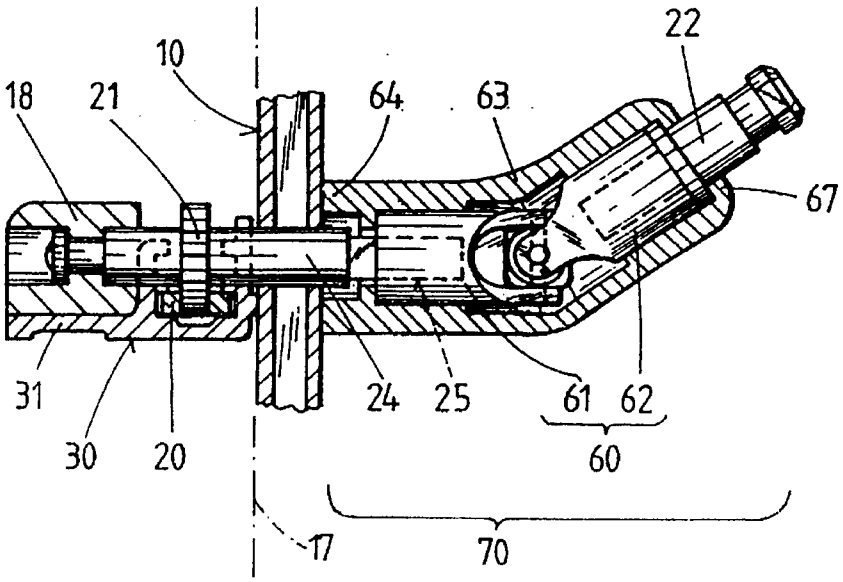
FIG. 14
FIG. 15
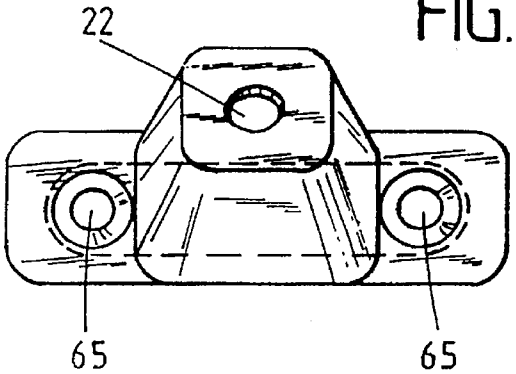
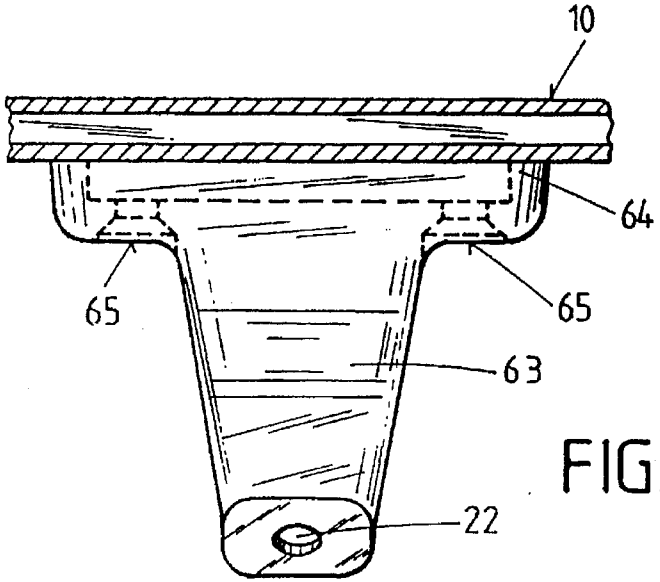
FIG. 16

DEVICE FOR OPENING AND CLOSING A WINDOW, A DOOR, OR THE LIKE

BACKGROUND OF THE INVENTION a) Field of the Invention

The invention is directed towards a device of the type which moves a window casement between a closed and an open position with respect to a stationary window frame by means of a longitudinally displaceable toothed rack. In order to do this, a driving pinion is rotatably mounted in the frame, which engages with the toothed rack, and which, for example, can be rotatably operated by means of a crank handle.

b) Description of the Related Art

In the known device of this type (US-PS 1 671 362) the carrier is connected in a fixed manner to the toothed rack and has a slit with which a tongue with a guide pin, fixed onto the casement, engages. To ensure the closed position of the casement, at least one pair of closing elements with mutually complementary closing elements has to be arranged between the casement and the frame. An additional handle is necessary to transfer the moveable closing elements of these pairs from their latched position, in which they keep the casement in the frame, into an unlatched position, in which the casement is released. An additional space on the casement or on the frame is required for this handle. As the rotary operation of the driving pinion must be carried out to coincide with the operation of the handle, the manipulation of this known device was awkward. Faulty operation could occur, leading to damage to the components.

In a device of another type (DE-OS 41 09 852), a lever perpendicular to the plane of the frame of the window frame is pivoted by means of a crank mechanism to move the casement, and the lever is connected to the casement in an articulated manner by means of a connecting rod. A rod for moving the pairs of casing elements is arranged in the casement and connected to the connecting rod. The moveable closing elements of these pairs of closing elements are arranged on the casement, while the associated stationary closing elements are located on the window frame. Although the closing elements on the casement side are also moved between their latching and unlatching positions by means of the crank mechanism, this changing over is done by means of the connecting rod, that is to say the same member used for moving the casement between its open and closed positions. The rod for moving the closing elements is arranged in line with the members used for moving the casement, that is the pivoting lever and the connecting rod. In order to eliminate faulty operation, the rods for moving the closing elements in the casement must be blocked by a stop which is rendered inoperative when the casement comes into contact with the frame. This necessitates additional manufacturing and assembly costs. The arrangement of the stop on the casement takes up space.

OBJECT AND SUMMARY OF THE INVENTION

The primary object of the invention is to develop a reliable, space-saving device of the above type which only requires a single actuator for operating all of the functions. This object is attained according to the claimed features of the invention; of particular importance are the following aspects of the invention.

In the invention, the changing over of the closing elements between their latching and unlatching position is carried out by the same driving means as the movement of the casement. For both actions, the toothed rack which is longitudinally displaceable by means of the rotary operation of a drive pinion is used. However, already on the toothed rack the further drive paths for the two functions split into two branches, the starting point of which are two independent carriers which alternately engage with the common toothed rack. Only one of the two carriers is permanently connected to the casement and moves the casement between its closed and open position. The other carrier is, in contrast, permanently connected to the moveable closing element of the pair of closing elements, which is now arranged in the window frame and can be moved between the latching and unlatching position thereof with respect to the associated stationary closing element, which is now located on the casement. This second carrier can also be connected to a so-called central locking system, by means of which several closing elements arranged at different positions in the window frame can be moved. The controlling movements required for the two functions are carried out by means of the two carriers, substantially only in the longitudinal direction of the toothed rack, that is to say, always in the same plane of the frame of the window frame. For this, a relatively narrow strip in the frame is sufficient to guide the toothed rack and the carrier. In this way an extremely space-saving device is obtained which, even while both functions are taking place, requires only a space in the direction of the extent of the window frame, so that this can be of a narrow construction. The device according to the invention requires no closing rods or the like, apart from a guide rod connecting the casement to the window frame, or a likewise connecting compound lever, so that the casement can also be very narrowly configured.

The two carriers are in this way not permanently connected to the toothed rack, but are coupled therewith by means of couplings which can respectively be independently rendered effective and ineffective. The carrier is only carried along by the toothed rack when the coupling is effective, but is stationary when its coupling is rendered ineffective. This rendering effective and ineffective of the two-way couplings is undertaken automatically at changeover locations, which are arranged at specific points along the path of longitudinal displacement of the toothed rack. These change-over locations are advantageously located where the movement of the casement or the displacement of the closing elements starts or ends. Should it be desirable, the change-over locations can be set with respect to the two carriers so that overlapping of these two functions occurs. It is however normally sufficient to arrange the change-over location so that only one of the two couplings is alternately effective, while the other is then rendered ineffective. The carrier, the coupling of which is rendered ineffective, should be stationary during longitudinal displacement of the toothed rack. The standstill of the carrier at the change-over location can be ensured by means of the coupling and/or by means of a stationary stop. The two working areas for the movement of the casement on the one hand, and the movement of the closing elements on the other hand can be set and subsequently adjusted by changing the position of the two change-over locations in the path of longitudinal displacement of the toothed rack.

Further measures and advantages of the invention can be seen from the subclaims, the following description and the drawings. Embodiments of the invention are shown in the drawings.

BRIEF DESCRIPTION OF THE DRAWINGS

In the drawings:

FIG. 11 illustrates a cross-section through the components in FIG. 9 and FIG. 10 along the line of intersection XI—XI shown therein;

FIG. 12 illustrates a section taken parallel to the intersection of FIG. 11, through the device shown in FIGS. 9 and 10 along the line of intersection XII—XII shown therein.

FIG. 14 illustrates a cross-section, enlarged with respect to the drawing in FIG. 2, through a section of the window frame with some components of the device according to the invention along the line of intersection XIV—XIV of FIG. 2;

FIG. 15 illustrates the front view of an angle housing used in FIG. 14;

FIG. 16 illustrates a corresponding plan view of the angle housing shown in FIG. 15;

DESCRIPTION OF THE PREFERRED EMBODIMENTS

Figure 1:
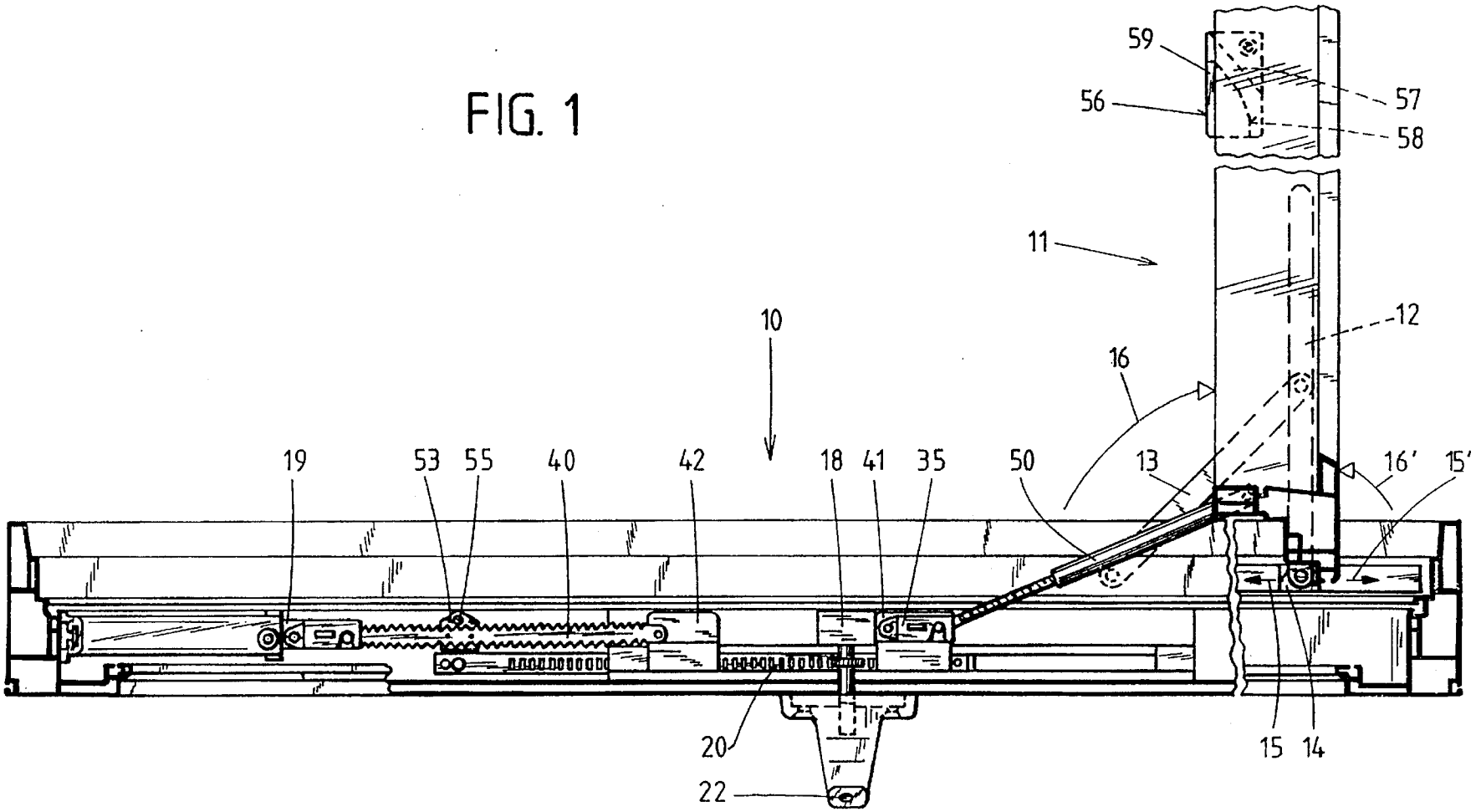
FIG. 1 illustrates a horizontal section through the lower part of the window frame and of the casement with a first embodiment of the device according to the invention, when the casement is in its open position.

The device is installed in a window which is composed of a stationary window frame 10 and a casement 11, 11' moveable with respect thereto. The casement is moveable between an open position 11 shown in FIG. 1 and a closed position 11' shown in FIG. 2, by means of the device. Shortly before reaching the closed position 11' shown in FIG. 2, the ventilation gap position 11" shown in FIG. 13, which will be described in more detail, can also be obtained with this device. As shown best in FIG. 1, the casement 11 is connected to the window frame 10 by means of hinge pieces, which in the present case are composed of a "sliding compound lever", which is arranged on the lower as well as the upper horizontal bars of the window. In the present case, this sliding compound lever is composed of a main arm 12, which is fixed to the lower horizontal arm of the window 12 shown, and the outer end of the arm is seated in a slider 14 in an articulated manner, wherein the slider 14 is guided parallel in the lower bar of the window frame 10. A guide rod 13 connects the main arm 12 to the window frame 10 by means of fixed pivoting points. As can be seen by comparing FIGS. 1 and 2, the casement carries out a combined movement 15, 16 in the direction of the arrow 15 indicating rotary movement and the arrow 16 indicating longitudinal movement shown in FIG. 1.

Figure 2:
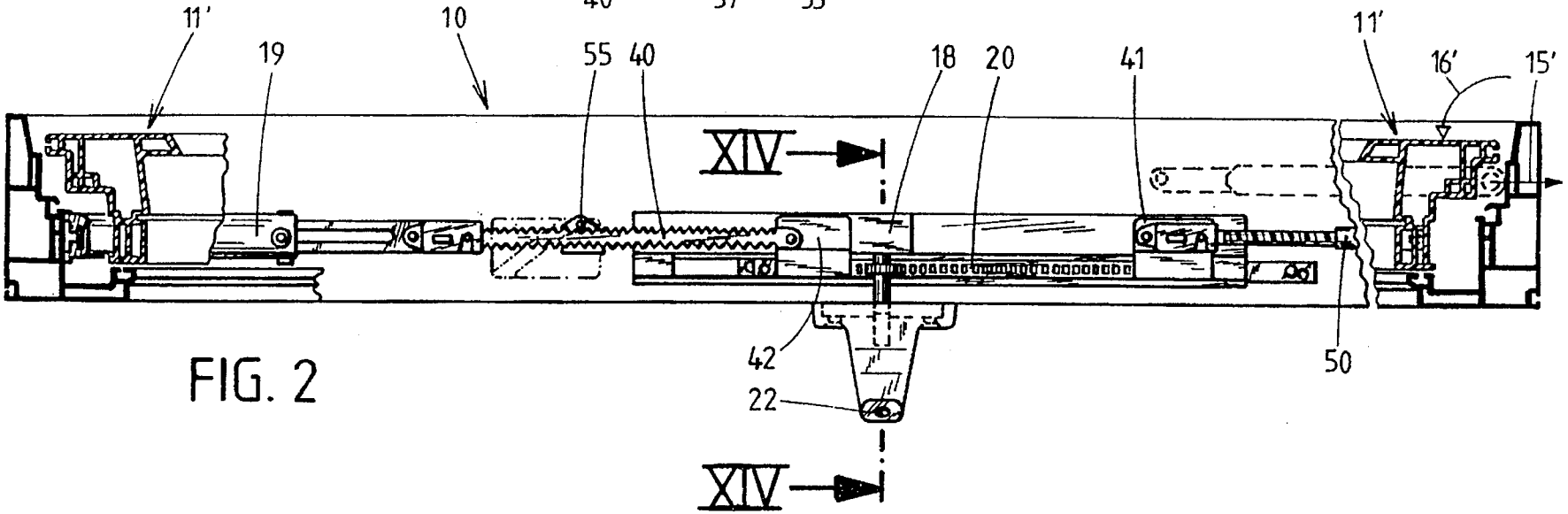
FIG. 2 illustrates a representation according to FIG. 1, showing the corresponding relationships when the casement is in its closed position in the window frame.
Figures 3, 4:
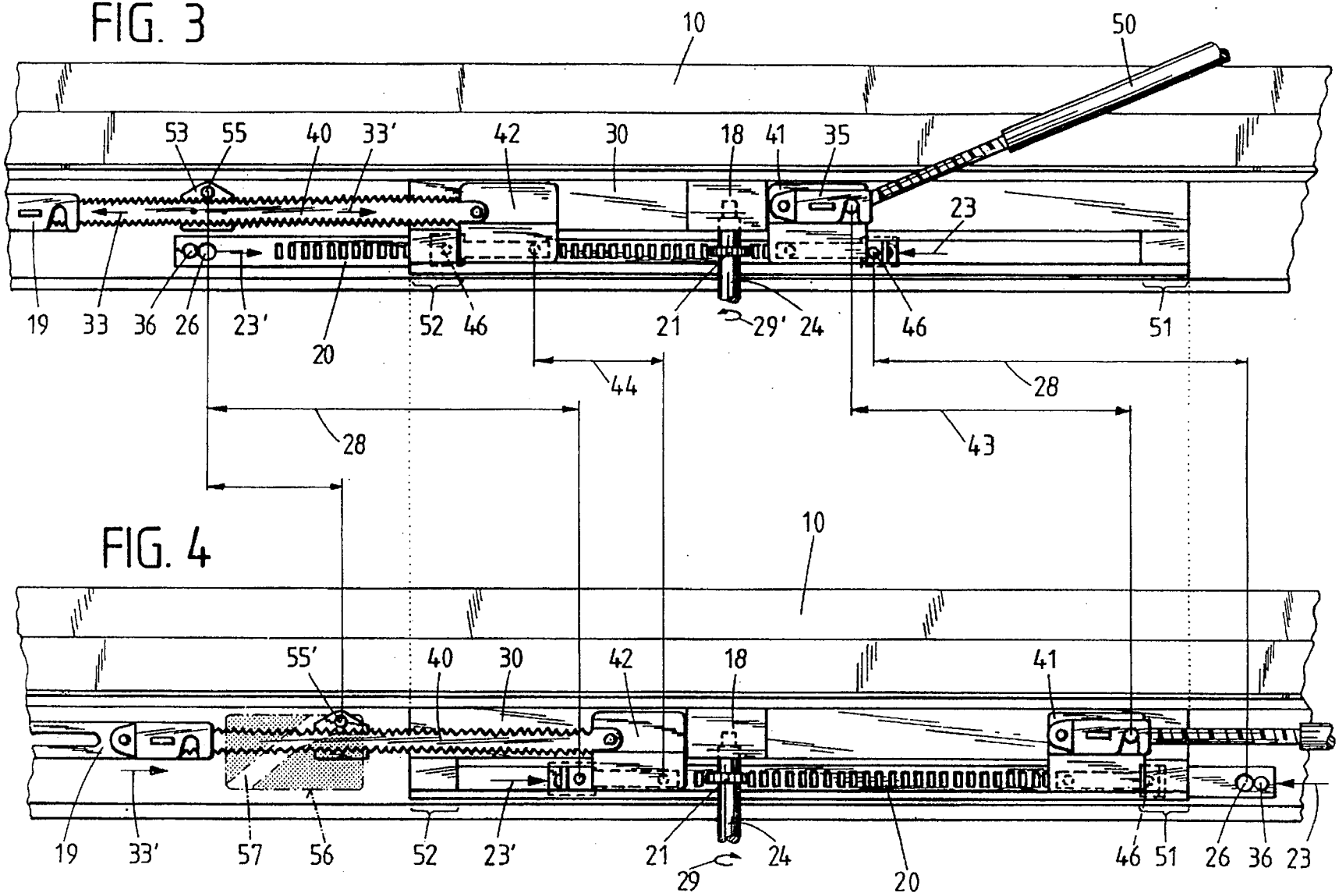
FIG. 3 illustrates, in plan view, the essential parts of the device according to the invention, not showing adjacent parts, in the open position according to FIG. 1.
FIG. 4 illustrates a representation according to FIG. 3 showing the relationships when the device is in the closed position according to FIG. 2.

This movement 15, 16 proceeds from a toothed rack 20 shown in FIGS. 3 and 4 which is fixed to the lower bar of the window frame 10 by means of a guide housing 30 in which it is received. The toothed rack 20 is engaged with a drive pinion 21, which can be actuated in a rotary manner by any actuating mechanism, for example, by a crank handle, which is not shown in more detail. Depending upon the direction of rotary actuation of the driving pinion 21 the toothed rack 20 is displaced longitudinally in the direction of the arrows 23, 23'. The connection point of such a crank handle is designated 22 in FIGS. 1, 2 and FIGS. 14 to 16. As best shown in FIG. 14, the axle 24 of the driving pinion runs perpendicularly to the plane of the frame 17 of the window frame 10 shown by broken lines. The inner axle end is received in a bearing part 18, which advantageously is seated on a shoulder 31 of the guide housing 30, used for fixing. The axle of the pinion 24 protrudes externally together with a drive bolt 25 through an opening in the profile of the window frame 10 and could be connected to the crank handle mentioned by means of a plug-in connector. Instead of a crank handle another driving device could also be used, for example, an electrically-driven motor drive.

In the present case the drive bolt 25 is indirectly connected to the connection point 22 for the crank handle via the two members 61, 62 of a universal joint 60. The universal joint 60 is received in an angle housing 63 and together therewith forms a component 70 which can be pre-assembled. One end 64 of the housing of the component 70 is joined to the window frame 10, wherein a plug-in connection between the protruding pinion-drive bolt 25 and the universal joint member 61 located there occurs. This end 64 of the housing can be fixed to the exterior of the window frame 10 by screws or the like by means of the fixing points 65 shown in FIGS. 15 and 16. On the opposite end 67 of the housing of this component 70 the connection point 22 mentioned, for a crank handle or another actuating mechanism, protrudes. A component of this type can also be advantageously used with devices with another type of toothed rack drive. These measures described hereinabove are therefore of an independent inventive significance.

An actuating mechanism of this type, such as the crank handle, is used according to the invention for the movement 15, 16 of the casement 11 as well as for moving the closing elements located in the window frame, and not described in more detail. Such closing elements are always made up of a mutually complementary pair and have the task of holding the casement 11' firmly against the window frame 10. In this way the closed position 11' of the casement, shown in FIG. 2, is ensured. Several pairs of closing elements of this type can be provided. Each pair of closing elements is composed of a stationary closing element provided on the casement on the one hand and on the other hand a moveable closing element arranged in the window frame 10. The moveable closing element located in the window frame 10 is moveable by means of a closure rod 19 shown in FIGS. 1 to 4, and can be moved therewith between the two end positions shown in FIGS. 3 and 4. This movement occurs when the casement is located in its closed position 11' according to FIGS. 2 and 4. In FIGS. 2 and 4 the closure rod 19 is located in a first end position which results from a displacement indicated by the arrow 33'. There is then a movement of the adjustable closure element with respect to the stationary closure element. The casement 11' is firmly held on the window frame 10. The closure rod 19 is transferred, by displacement in the opposite direction in the sense of the arrow 33' shown in FIG. 3, to the second end position shown therein, which effects the unlatching position of the moveable closing element located in the window frame 10 with respect to the stationary closing element located on the casement. Now the casement 11' is released and can be moved into its open position in the direction of the arrows 15, 16 as shown in FIG. 1.

Figure 5:
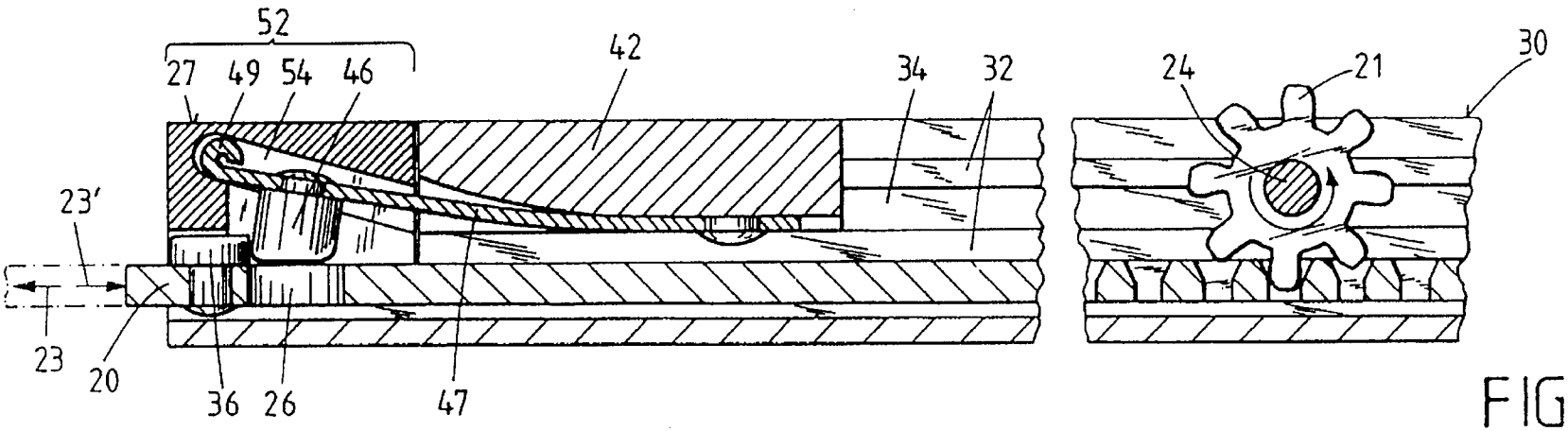
FIG. 5 illustrates an enlarged longitudinal section through the left-hand part of the device along the line of intersection V—V in FIG. 6, when the components are in an intermediate position between FIG. 3 and FIG. 4.
Figure 6:
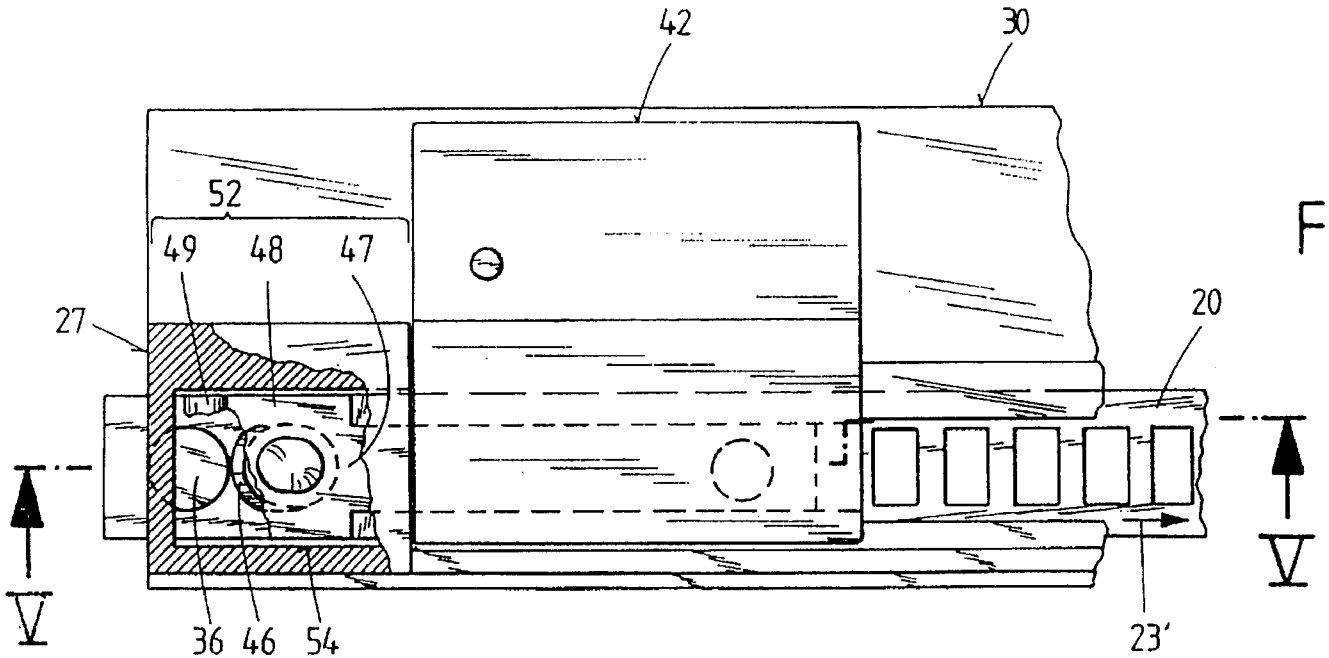
FIG. 6 illustrates, in plan view, the components in FIG. 5.

Two carriers 41, 42 are associated with the toothed rack 20, each of which is temporarily connected to the toothed rack 20 by means of a coupling 26, 46 which is best seen from FIGS. 5 and 6, and in this way locally carry out the longitudinal displacement 23, 23' thereof. As shown by the two final positions shown in FIGS. 3 and 4, the toothed rack 20 can be moved by means of its drive pinion 21 completely along the distance 28, however the two carriers 41, 42 take part in this movement in ways which are temporally and spatially different. The carrier 41 can move by means of the displacement path 43 and the carrier 42 by a comparatively smaller displacement path 44. This occurs because the previously mentioned couplings 26, 46 are each individually rendered effective or ineffective, and this always occurs automatically. For this change-over locations 51 or 52 are provided at two specific places in the path of longitudinal displacement 23, 23' of the toothed rack 20, one 51 of which is associated with the first carrier 41 and the other 52 with the second carrier 42. In the embodiment shown, the two change-over locations 51, 52 are located on the ends of the guide housing 30 in the embodiment shown, which, as shown best by FIGS. 11 and 12, is also provided with guide rails 32 for slipping the two carriers 41, 42 along. At these change-over locations 51, 52 an active coupling part 46 is rendered effective or ineffective with respect to a passive coupling part located at a specific place on the toothed rack 20. The rendering effective or ineffective of the coupling 26, 46 is carried out dependent upon the direction of displacement 23, 23' of the toothed rack 20, which will be explained in more detail. As both carriers 41, 42, both couplings 26, 46, and both change-over locations 51, 52 have the same configuration and are simply arranged in the mirror-image of each other, it is sufficient to consider only one out of these sets of components.

A set of components for the first embodiment of the device according to the invention, according to FIGS. 1 to 4 is shown in FIGS. 5 to 12 in different phases of operation. A further set of components for a second embodiment of the device according to the invention according to FIG. 17 will be described in more detail later, with reference to FIGS. 19 to 22. In the first embodiment according to FIGS. 1 to 10, a change-over member 27 is located at the change-over locations, the configuration and mode of operation of which can be seen in FIGS. 5 to 12. In these, although conditions are shown at the change-over location 52 with the carrier 41, they also apply in a mirror-image manner at the other change-over location 51, where the other carrier 41 is coupled and uncoupled with the toothed rack 20.

It is firstly assumed that the carrier 41 is coupled to the toothed rack 20. Then the conditions shown in FIG. 9 occur at the carrier 41. The active coupling part of the right-hand carrier 41 is composed in the same way as in the carrier 42 shown in FIG. 9, from a coupling pin 46 which engages with a coupling holder 26 of the toothed rack 20 functioning as a passive coupling part. In this way a longitudinal displacement 23 of the toothed rack 20, according to FIG. 3, is transferred to the carrier 41 and from there converted into the movements 15, 16 of the casement 11 already mentioned via a connecting rod 50. The completely open position of the casement 11 according to FIGS. 1 and 3 then exists, wherein the toothed rack 20 is located in its left-hand end position on its path of longitudinal displacement 28. The connecting rod 50 can be adjusted by changing its length. In the open position shown in FIGS. 1 and 3 the connecting rod 50 can easily be assembled or dismantled on the carrier 41 by means of a quick release connector 35, composed of a hinge pin and overlapping detent latch. The two carriers 41, 42 are then located, according to FIG. 3, in the left-hand end position of their two paths of displacement 43, 44.

The coupling pin 46 is on the free end of a leaf spring 47 fixed to the respective carrier 41 or 42, which endeavors to mesh with the coupling 26, 46 in the direction of the arrow of force 45 indicated in FIG. 9. Moreover, the end of the leaf spring 47 is provided with a broadening 48 of the spring according to FIG. 10, which engages in a guide groove 34 between the two parallel guide rails 32. In this way, by means for example of a thickened end piece 49, the end of the spring is forced into the groove 34. By means of this forcing 34, 49 undesired uncoupling of the respective carrier 41, 42 on the one hand and the toothed rack 20 on the other hand is excluded. While the carrier 41 which is responsible for the movement 15, 16 of the casement is coupled to the toothed rack 20, the other carrier 42 is uncoupled, which occurs in the following manner.

Uncoupling occurs when the relationships shown in FIGS. 5 and 6 occur. The coupling pin 46 of the carrier 42 is introduced into the change-over member 27 due to the displacement of the rod 23. The change-over member 27 has a channel 54, which while continuing the previously mentioned guide groove of the guide housing 30, forms a rising ramp up which the end piece 49 of the spring slides. According to FIG. 5 the coupling pin 46 is thereby forcibly lifted out of its coupling holder 26 in the toothed rack 20 and the leaf spring 47 bends. A certain degree of tightening can occur between the end piece 49 of the spring and the channel 54, by means of which the carrier 42 is retained in the rest position in the change-over member 27 shown in FIGS. 5 and 6.

After the toothed rack 20 is uncoupled according to FIGS. 5 and 6, it can be further displaced by means of the change-over member 27 in the direction of the arrow 23 as far as the final position shown in FIGS. 1 and 3. This behavior is shown in FIG. 5 by means of a broken line showing an extension of the toothed rack 20. As the second carrier 42 is now stationary, it does not transfer the longitudinal displacement 23 of the rack via an extension rod 40 to the closure rod 19 which is itself extendable and located in the frame. An unlatching position of the pair of closing elements controlled by the closure rod 19 occurs.

This coupling behavior of the two carriers 41, 42 is retained when the drive pinion 21 is rotated back in the direction of the arrow indicating rotary movement 29' in FIG. 3, and thereby begins the return displacement of the toothed rack 20 also indicated in FIG. 3 by the arrow 23'. While one carrier 41 is thereby carried along, and moves the casement back by means of the connecting rod 50 in the direction of the arrows 15', 16' shown in FIG. 1 towards the closed position 11' shown in FIG. 2, the other carrier 42 still remains stationary in its end position in the change-over member 27. The toothed rack 20 then moves back freely under the change-over member 27 in the direction of the arrow 23'. However, when the intermediate position as shown in FIGS. 5 and 6 is reached, a change-over movement of the coupling pin 46 on the carrier 42 begins. An end stop 36 located on the toothed rack 20 now effects the coupling.

Figure 7:
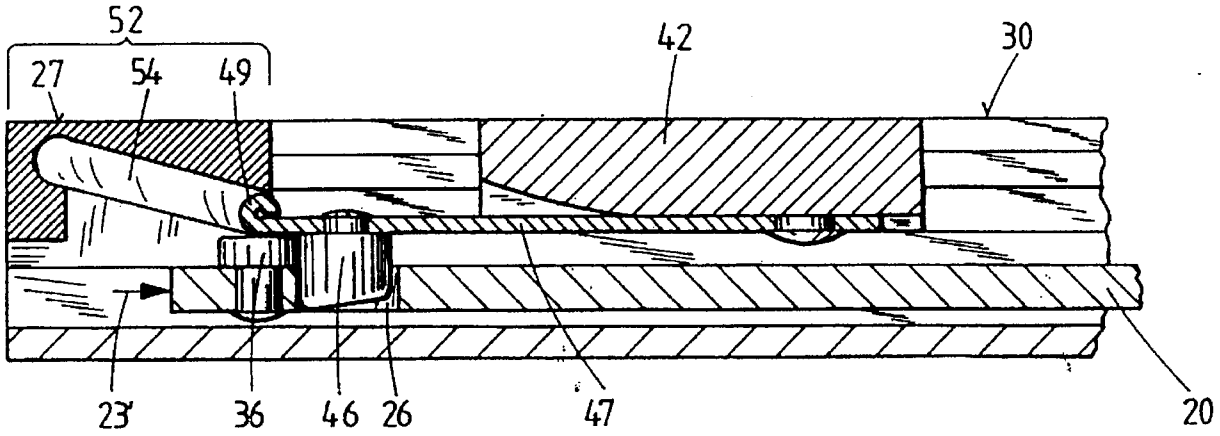
FIGS. 7 and 8, illustrate a longitudinal section corresponding to FIG. 5 and a plan view according to FIG. 6 of the same components in a phase of movement subsequent to those of FIGS. 5 and 6, FIGS. 9 and 10, again illustrate a representation of the components corresponding to FIGS. 5 and 6 in a position following the movement phase shown in FIGS. 7 and 8.
Figure 8:
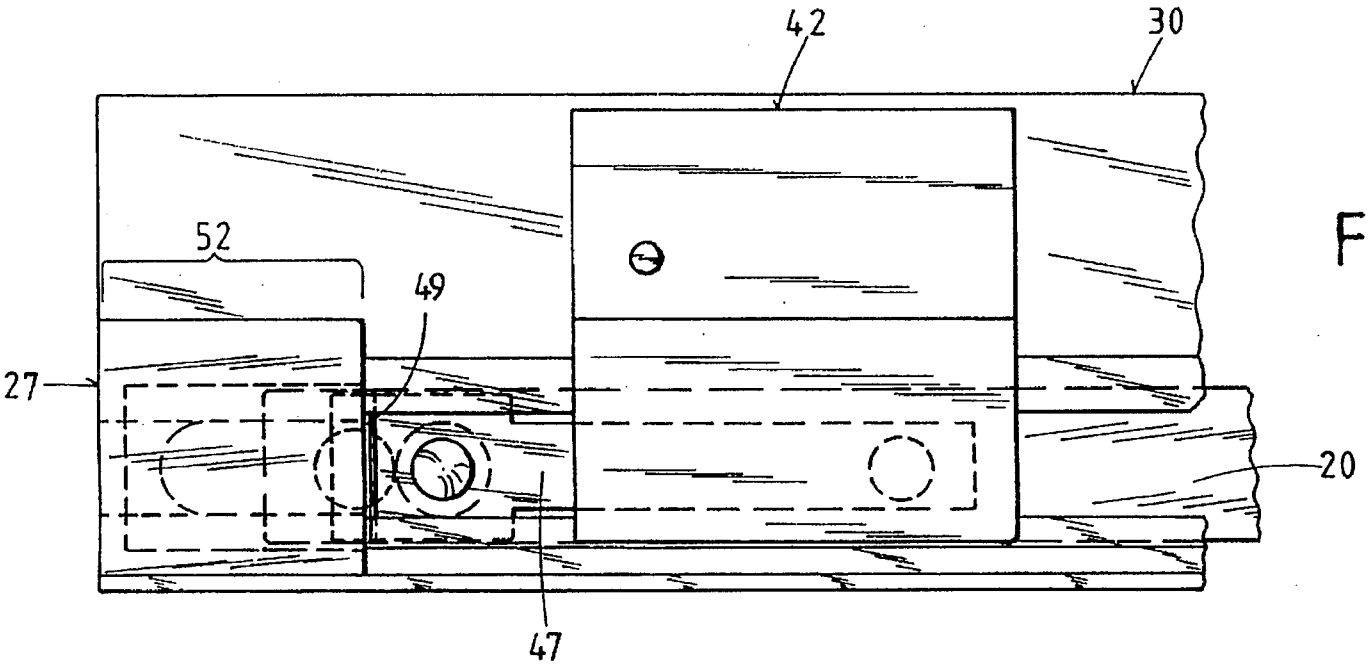

This end stop 36 is composed of a projection fixed to the toothed rack 20 which enters into the interior of the change-over member 27 where it impacts with a shoulder on the coupling pin 46 and carries it into the position shown in FIGS. 7 and 8. During this previously described outward displacement 23 of the toothed rack 20, the end stop 36 moves away from the coupling pin 46 with which it was in contact in its uncoupled position, into its end position shown in FIG. 3.

However, during the return displacement 23', according to FIGS. 5 and 6, the end stop 36 brings the coupling pin 46 into alignment with the coupling holder 26 in the toothed rack 20. The end stop 36 acts as a supplementary coupling part of the coupling holder 26. The return displacement 23' is transferred from then on to the carrier 42. In the intermediate position shown in FIGS. 7 and 8 the end part 49 of the spring which has been guided by sliding has moved up in the channel 54 of the change-over member and the coupling pin 46 is fully introduced into the coupling holder 26. This coupling of the carrier 42 to the toothed rack 20 is retained during the further return displacement 23' of the toothed rack 20, as can be seen from the subsequent movement phase shown in FIGS. 9 and 10. The casement moves in the direction of its closed position 11' in FIG. 2, as shown in FIGS. 1 and 2 by arrows 15', 16' indicating the closing movement.

Meanwhile the first carrier 41 has arrived in the area of the right-hand changeover location 51 as shown in FIGS. 3 and 4, where in this embodiment a further change-over member 27 of the type described is located. In this way the coupling 26, 36, 46 located on the carrier 41 is rendered ineffective in a manner which is the mirror image and in reverse of the movement procedure in FIGS. 5 to 10. The coupling pin 46 located at that point is lifted by means of an inclined channel 54 corresponding to that shown in FIG. 5 in the other change-over member 27 belonging thereto, out of the coupling holder 26. When the end of the desired path of longitudinal displacement 43 is reached, the carrier 41 is stationary and the connecting rod 50 is no longer moved.

The movement 15', 16' of the casement determined by the carrier 41, according to FIGS. 1 and 2, is thus ended, however a further movement 15', 16' of the casement can still be carried out by means of the second carrier 42.

This second carrier 42 is namely coupled to the toothed rack 20, is carried along during the return displacement 23' and transfers its movement by means of the connecting rod 40 mentioned to the closing rod 19. With this the return movement 33', already described, according to FIG. 4 is completed, where the moveable closing elements in the frame 10, as previously mentioned, move from their unlatching position gradually in the direction towards their latching position. The complete latching position is only reached in FIGS. 2 and 4. The closing rod 19 proceeds to fulfil yet another function. The final phase mentioned of the Closing movement 15', 16' of the casement is done by means of the carrier 42 in the following manner.

Figure 13:
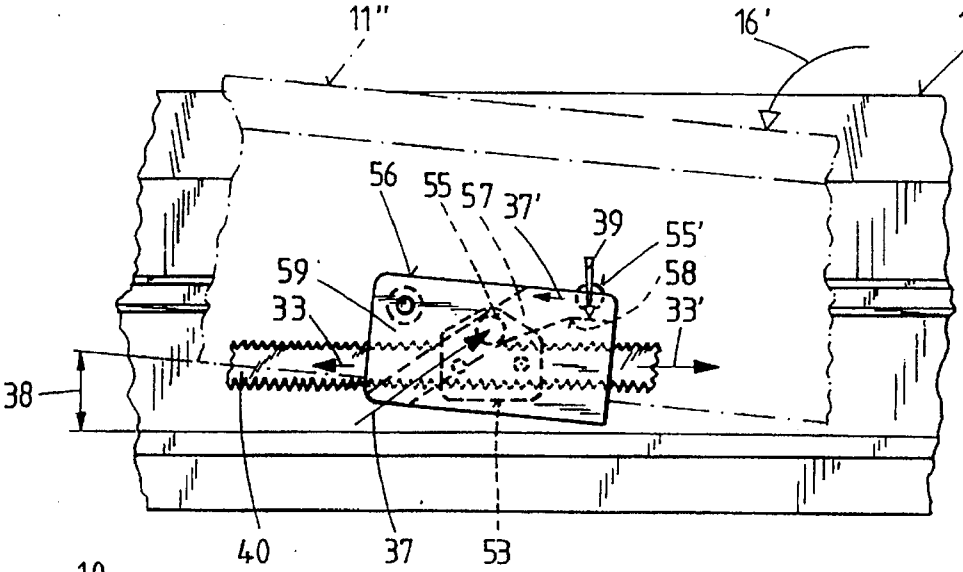
FIG. 13 illustrates the previous drawing enlarged, showing the relationships in the area of the device according to the invention when the casement according to the invention is in a so-called ventilation gap position which, proceeding from the open position shown in FIG. 1, occurs shortly before reaching the completely closed position shown in FIG. 2.

As can be seen from FIGS. 1 and 4, between the casement 11 and the rod extension 40 a pair of radial cams 55, 56 is arranged. This pair of radial cams is composed of a control member 55 fixed to the rod extension 40 which can be moved along therewith, and an opposing control member 56 which is stationary on the casement 11. The control member on the rod side is in this case a control pin 55 with a round profile which protrudes from a retaining plate 53 fixed to the rod extension 40. The opposing control member 56 on the casement side includes, as shown in FIG. 13, a control channel 57 with shaped channel sides 58, which are component parts of an assembly plate 59 to be fixed to the lower horizontal bar of the casement 11. The control and opposing control member 55, 56 are not only mutually profiled in a specific manner, but are also fixed at specific points for carrying out controlling movements.

In FIG. 13 the casement is shown in a so-called "ventilation gap position" in which as shown therein by broken lines, the casement 11" is still at a small ventilating distance 38 away from the frame 10. Because of the predetermined closure movement 16' of the casement and the return movement 33' of the rod extension 40, the control pin 55 is inserted in the direction of the arrow 37 shown in FIG. 13 into the control channel 57 of the opposing control member 56 and remains stationary therein between channel sides 58 which border it on both sides. If the further rotary actuation 29' of the drive pinion 21, shown in FIG. 3 is now interrupted, the control pin 55 remains in this position in the control member 56 over the then stationary carrier 42. This results in a specific gap width 38 shown in FIG. 13, between the casement 11" and the frame 10.

If a smaller gap width 38 is desired, the toothed rack 20 simply has to be displaced back by further turning 29' of the pinion 21. This results in a further return movement 33' of the control pin 55 by means of the carrier 42. The control pin 55 moves further down into the control channel 57 and presses against the opposing control member 56 by means of the inside channel sides 58, and thereby moves the casement 11" in the direction of the arrow 39 indicating the pressing shown in FIG. 13 nearer to the frame 10. This inside channel side 58 is shaped so that in the position 55' indicated by broken lines in FIG. 13 and solid lines in FIG. 4, the control pin 55 engages behind the casement-side opposing control member 56. The position of this opposing control member 56 in the closed position 11' in FIG. 2 is indicated by dotted hatching in FIG. 4. The pair of radial cams 55, 56 therefore acts firstly in a specific movement 16' of the casement 11" in the final phase. Furthermore at 55' the pair of radial cams finally latches the casement into its completely closed position 11' with respect to the window frame 10.

In order to open the casement again from its closed position 11' shown in FIG. 4, the closing elements which are in the latched position must first be transferred by means of their rod 19 into the unlatched position. Both the opening movement 15, 16 of the casement and the change-over of the pair of closing elements is done by an opposite rotary movement 29 of the drive pinion 21 as shown in FIG. 4. This also results in the previously mentioned longitudinal displacement 23 of the toothed rack 20. The coupling 26, 46 is temporarily ineffective in the area of the casement-side carrier 41, but the second carrier 42 is coupled to the toothed rack 20 and takes part in its longitudinal displacement 23. In this way the movement 33, already mentioned several times, of the closing rod 19 towards the position shown in FIG. 3 takes place by means of the rod extension 40 coupled thereto. Proceeding from its latched position indicated by 55' this shows itself firstly in a telescopic movement of the control pin indicated in FIG. 13 by the arrow 37'. The control pin impacts with the outer channel sides of the control channel 57 and during the further rotation 29 of the drive pinion 21 effects a pushing away of the casement. This results again firstly in the ventilation gap position 11" in FIG. 13 already described. The control pin 55 then moves along the two shaped sides of the control channel 57 as far as the exit end in the casement-side opposing control member 56.

During this, a change-over of the couplings 26, 46 of the two carriers 42, 41 takes place by leaving the change-over member 27 or respectively by entering the corresponding change-over member on the change-over location 51. The carrier 42 has arrived, according to FIG. 3, at the left-hand end point of its path of displacement 44 and the first carrier 41 begins its movement at the right-hand end of its path of displacement 43 shown in FIG. 4. The further opening movement 15, 16 of the casement 11 is then effected exclusively by means of the carrier 41, while the carrier 42 remains stationary.

Figure 17:
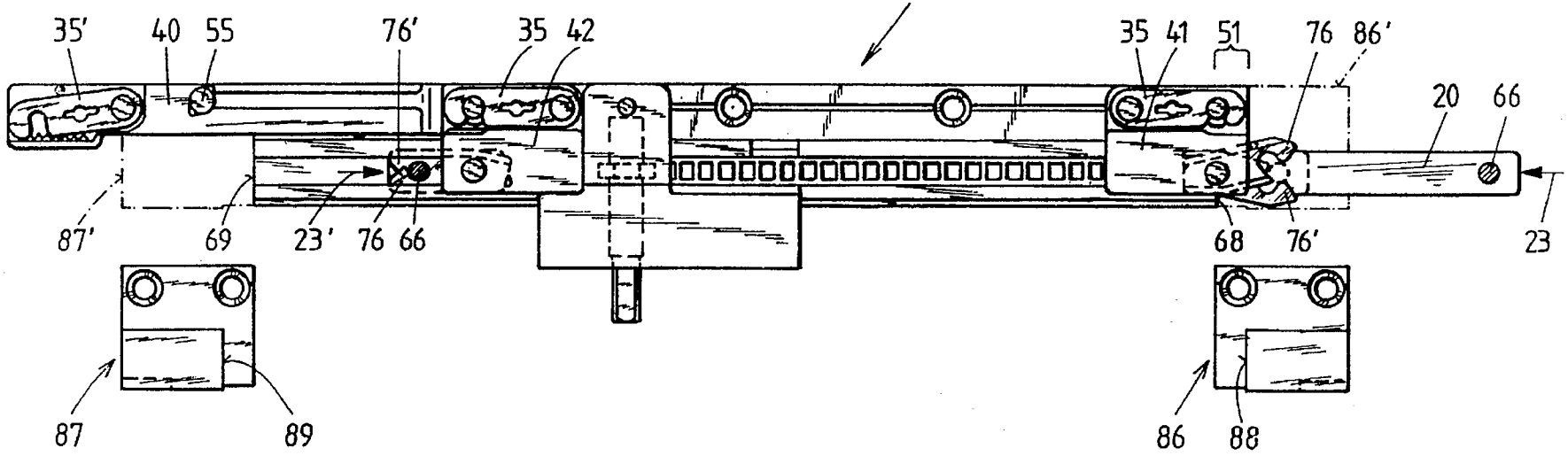
FIG. 17 illustrates, in plan view, corresponding to FIG. 2, a second embodiment of the device according to the invention, wherein the casement, in its closed position, is not shown.

In FIGS. 17 to 22 a second embodiment of the device according to the invention is shown. In this the corresponding components will be designated with the same reference numerals as for the first embodiment. The preceding description is applicable to this extent. It is sufficient simply to examine the differences. These exist above all in another configuration of the coupling 66, 76, 76' between the two carriers 41, 42 on the one hand and the toothed rack 20 on the other hand. As also in this case the couplings belonging to the two carriers 41, 42 have the same configuration it is sufficient to describe only one, which is to say the coupling 66, 76, 76' belonging to the right-hand carrier 41 as shown in FIG. 17, with the aid of FIGS. 19 to 22.

Also in this case the active coupling, which is composed of at least one pivotable hook 76, is located on the carrier 41. The hook 76 is in this case formed from a first outer arm 71 of a two-armed lever 71, 72 and has a profiled hook-opening 73. In the present case the carrier 41 is provided with two hooks 76, 76' pivotable in a mirror-image manner with respect to one another, which have hook-openings 73, 73' facing towards each other. Both hooks 76, 76' are located on a common journal 77 which is attached to the carrier 41, which is shown in particular in FIG. 20. The associated passive counter coupling is composed of a trunnion 66 arranged vertically on the end of the toothed rack 20, which cooperates with the hook-openings 73, 73' of the two hooks 76, 76' As both hooks 76, 76' have the same configuration and are only arranged in a mirror-image manner on the toothed rack 20, it is sufficient to describe only one, that is to say 76, thereof.

Figure 19:
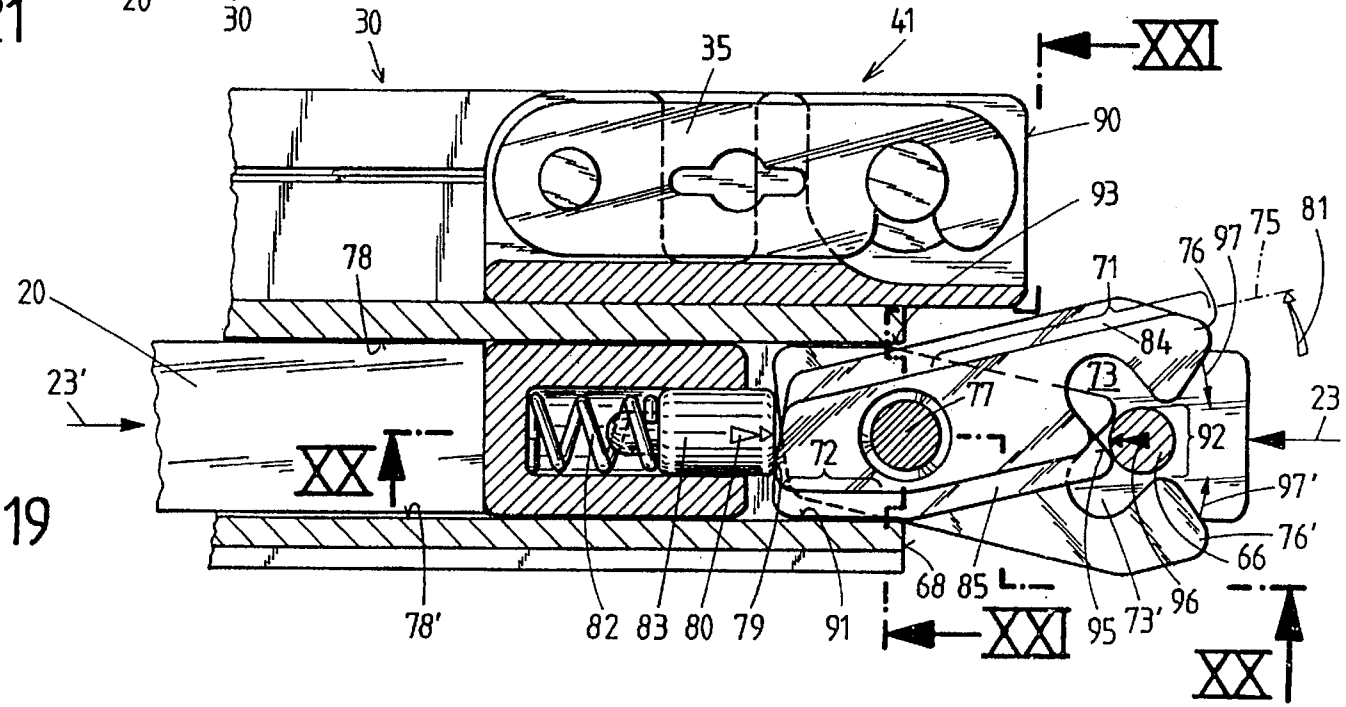
FIG. 19 illustrates the right-hand end piece, greatly enlarged, of the device according to FIG. 17, partially in section along the projecting line of intersection XIX—XIX shown in FIG. 21.
Figure 22:
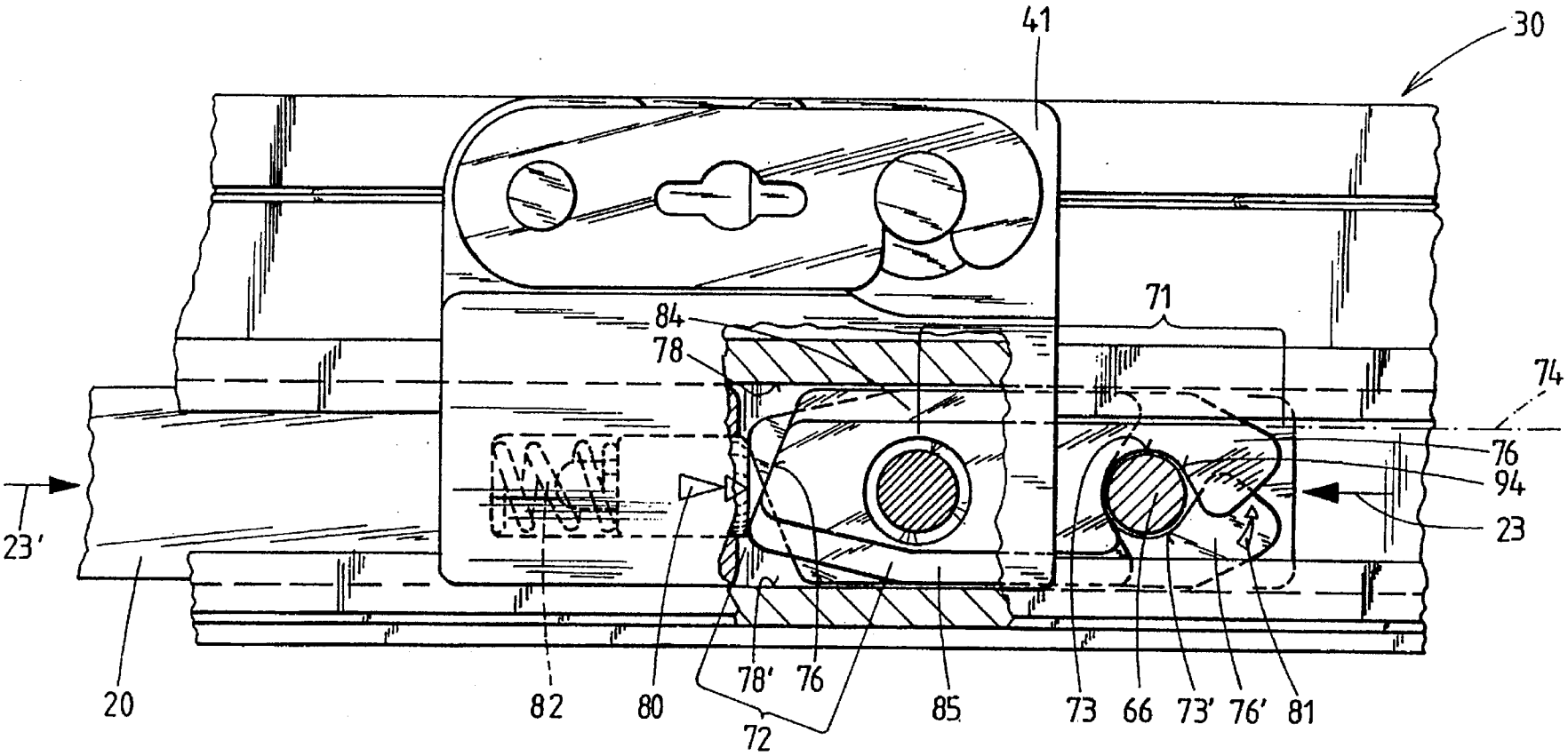
FIG. 22 illustrates a plan view of the area of the device already shown in FIG. 19, partly fragmented, when it is located in a position corresponding to that of FIGS. 1 to 3, of the first embodiment, which characterized the open position of the casement.

The hook 76 is pivotable in a plane parallel to the toothed rack 20 with respect to the trunnion 66 between two positions, namely a closed position according to FIG. 22 making coupling effective, and a braced position according to FIG. 19 making coupling ineffective. The closed position of the hook 76 is indicated by a dashed subsidiary line 74 in FIG. 22. In this case the hook-opening 73 clasps the trunnion 66. The braced position is characterized by a corresponding subsidiary line 75 in FIG. 19, where the hook-opening 73 releases the trunnion 66. In its closed position 74 the hook is substantially parallel to the longitudinal direction of the toothed rack 20 and is thereby supported on at least one guide surface 78 which extends parallel to the longitudinal displacement 23, 23' of the toothed rack 20. The hook 76 is acted upon by a bracing force 81 indicated by a curved arrow in FIG. 19, which endeavors to transfer the hook 76 into its braced position 75. This bracing force 81 is produced, in the present case, by a spring 82 integral with the carrier 41, which in this case is configured as a compression spring. The compression spring 82 acts parallel to the longitudinal displacement 23, 23' of the toothed rack 20 and firstly exerts an axial spring force 80 upon the end face 79 of the second inner lever arm 72 belonging to the hook 76, by means of a slide 83. Between the contact surface of the slide 83 and the end face 79 of the inner lever arm 72 there is an inclined profile which converts the axial spring force 80 into the bracing force 81 on the hook 76. In the present case this inclined profile is produced by an oblique path from the end face 79 of the lever arm 72, as can be seen from FIG. 22. The bracing force 81 could also be produced directly by a spring, which is configured, for example, as a torsion spring.

Figure 21:
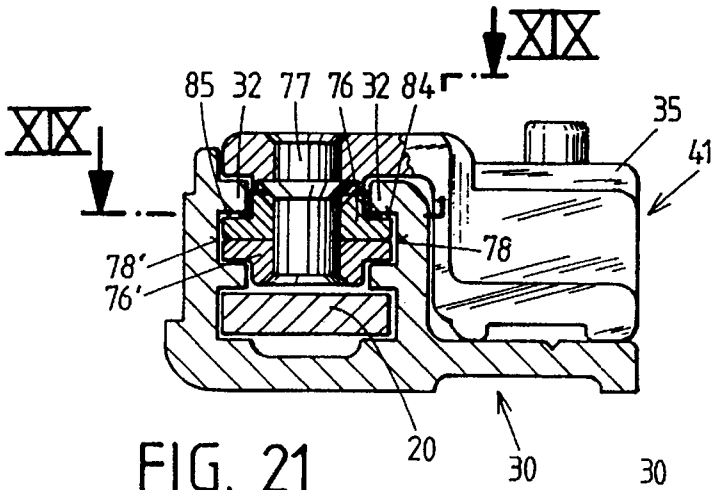
FIG. 21 illustrates a cross-section through the device from FIG. 19 along the projecting line of intersection XXI—XXI located there.

As can best be seen from FIG. 21, the two longitudinal edges 84, 85 of the hook 76, which is configured as a two-armed lever 71, 72 are offset in a stepped manner. When the toothed rack 20 is displaced longitudinally 23, 23', according to FIG. 22, the longitudinal edge 84 is supported on the guide surface 78 mentioned, and presses the associated hook 76 against the bracing force 81 acting upon it into its closed position 74 on the trunnion 66. When the toothed rack 20 is displaced longitudinally 23, 23', the hook 76 slides, together with its offset long edge 84, along this guide surface 78. The opposite offset longitudinal edge 85 is located on a second guide surface 78' parallel and a distance from the guide surface 78. As can be seen from FIG. 21 these two guide surfaces 78, 78' are configured as integral with the guide housing 30 for the toothed rack 20, already described, in which the guide rails 32 for the two carriers 41, 42, already described with reference to the first embodiment, are located.

The corresponding conditions also apply to the other two-armed hook 76' arranged in a mirror-image. By means of the slide 83 the compression spring 82 acts commonly upon the two hooks 76, 76' which as can be seen from FIG. 22 are retained, clamped together in a pincer-like manner and clasp the trunnion 66 between them when the respective longitudinal edges 84 of the two outer lever arm forming the hooks 76, 76' lie on the bilateral guide surfaces 78, 78'. By means of the trunnion 66 and the two hooks 76, 76' a reliable coupling exists between the toothed rack 20 and the carrier 41 insofar as the two hooks 76, 76' are supported by the guide surfaces 78, 78' of the toothed rack housing 30. This changes only when the carrier 41 nears the area of its change-over location 51 according to FIG. 17. This occurs in the same sense for the other carrier 42 at its change-over location 52 shown in FIG. 17.

Figure 18:
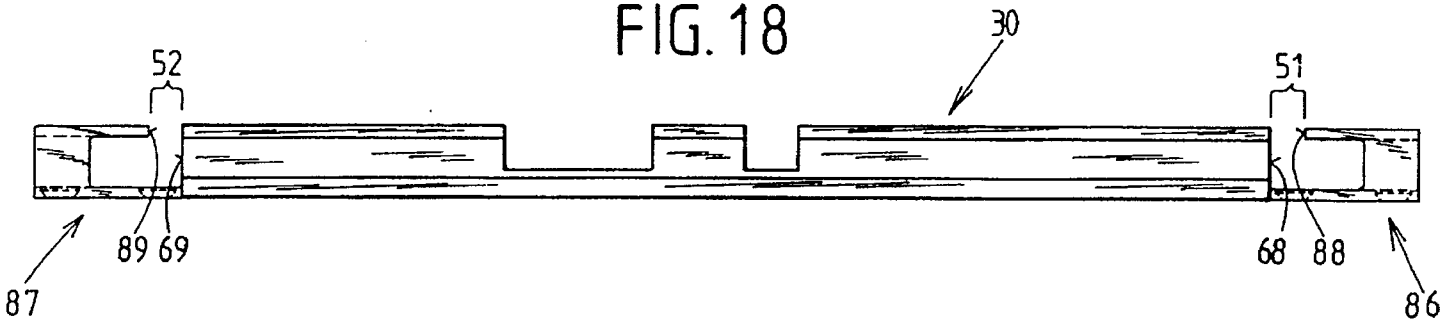
FIG. 18 illustrates the front view of a guide housing used in the device according to FIG. 17 with movement limiters arranged at both ends, which in FIG. 17 have not yet been mounted in their final position, indicated by dashed lines, on the frame, which is indicated by dashed lines therein.

As can be seen from FIGS. 17 and 18, the two change-over locations 51, 52 are delimited on one side by the two end faces 68 or 69 of the guide housing 30 in which the toothed rack 20 is longitudinally guided. On the other side the two change-over locations 51, 52 are delimited respectively by a stationary stop 88 or 89. These stops 88, 89 belong to two movement limiters 86, 87 which are fixed to the frame of the window, the door, or the like and cooperate with corresponding counter stops on the two associated carriers 41, 42. These limiters 86, 87 are shown laterally offset with respect to their mounting points 86', 87', indicated by dashed fines in FIG. 17, in order to make the end-side components of the device visible.

Figure 20:
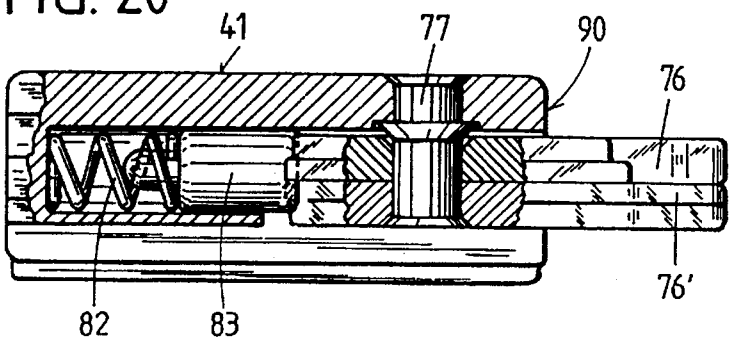
FIG. 20 illustrates the front view of a detail from FIG. 19, partially cut away along the line of intersection XX—XX of FIG. 19.

The actions produced at the change-over location 51 are shown in FIG. 19. In FIG. 19 one end position of the carrier 41 is shown, which is produced when the toothed rack, currently coupled, is displaced outwardly 23'. This end position is determined in that the front edge 90 of the carrier 41, as shown in FIG. 20, impacts with the associated stop 88 of the movement limiter 86 shown in FIG. 18. This movement limiter 86 is not shown in FIG. 19. This front edge 90 of the carrier 41 is, in this embodiment, the previously described counter stop. In this end position of the carrier 41 the outer lever arms 71 forming the respective hooks 76, 76' are driven beyond the housing end-face 68 and are thereby no longer supported by their guide surfaces 78 or 78'. The bracing force 81 can develop and the braced position 75 already described occurs. The angle of this braced position 75 is determined in that the inner lever arm 72 is provided with a continuing arm edge 91 at an angle to the leading longitudinal edge 85, which because of this bracing force 81 is supported in contact with the opposite guide surface 78' of the housing 30. In this way between the ends of the two hooks 76, 76' a sufficient large gap 92 exists through which the trunnion 66 located on the toothed rack 20 can come out with further pushing 23'. Then the effects occur which are described with reference to the first embodiment in connection with FIG. 4.

When the carrier 41 is located on the change-over location 51 and the previously described conditions shown in FIG. 19 are present, the carrier 41 is also prevented from being moved inadvertently in the opposite direction, namely away from the stop 88. This is achieved by the hooks 76, 76' located in their braced position 75, as these are supported, together with their respective longitudinal edges 84 on the housing edges 93 on the end face 68 of the guide housing 30. The axial spring force 80 braces the two hooks 76, 76' part, which then cooperate with the housing end-face 68 in a sprung manner, like the elements of a snap fastener, and thus secure the end position of the carrier 41. A detent could even be provided in this case when an undercut shoulder is provided on the longitudinal edge 84 of the respective hook 76 or 76' which is not shown in this embodiment, which, in the braced position 75 of the hook 76 grasps like a tooth behind, for example, the edge 93 of the housing 30. In this way the end position of the carrier 41 is blocked in both directions.

The pincer-like spreading apart of the two hooks 76, 76' can be assisted by a suitable profiling between the trunnion 66 and the hook-opening 73 or 73'. In the closed position according to FIG. 22 the outer flank 94 of the hook opening 73 has an oblique path with respect to the outwardly directed movement of the trunnion 66 which has a circular profile. The force to be converted between the trunnion 66 and the hook 76 during the outward displacement 23 of the toothed rack 20 allows a component of force to arise by the inclined position of the outer flank 94 which assists the bracing movement of the hook 76 in its braced position 75 shown in FIG. 19 as soon as the longitudinal edge 84 of the lever arm 71 forming the hook no longer lies on the guide surface 78. Then because of the profiling between the trunnion 66 and the hook-opening 73 a force occurs acting in the direction of bracing. In many applications a bracing force 81 conducted from a spring 82 could then be dispensed with.

By means of an inward displacement 23 in the opposite direction, of the toothed rack 20, at the change-over location 51 rendering effective of the coupling 66, 76, 76' located there again occurs. The trunnion 66 is guided against the outwardly inclined inner flank 95 of the hook-opening 73 which together with the mirror-image behavior of the corresponding inner flank of the opposite hook-opening 73' forms a fork-shaped aggregate profile according to FIG. 19. When the trunnion 66 coming from the opened gap 92 meets the inclined inner flanks 95 of the two hooks 76, 76' an aggregate force 96 is transferred as shown in FIG. 19 by the arrow 96. This aggregate force 96 produces two inclined components of force on these inclined inner flanks 95, which act in the opposite direction to the bracing force 81 coming from the spring 82, and close together the two hooks 76, 76' in a pincer-like manner in the direction of the arrows 97, 97'. As soon as the closed position 74 of the respective hook 76 or 76' shown in FIG. 22 occurs, the support described between the respective longitudinal edge 84 of the hook and the housing edge 93 ceases. The two hooks 76, 76' are guided together closely enough for them to be inserted into the space between the two guide surfaces 78, 78' of the guide housing 30, where the bracing force 81 caused by the spring acting upon them is again absorbed. The effective coupling shown in FIG. 22 between the carrier 41 and the toothed rack 20 then occurs again.

As was explained already with reference to the first embodiment in FIGS. 2 and 4, in this second embodiment a closure rod is also fixed to the other carrier 42 directly or indirectly by means of an extension rod 40. The extension rod 40 may also be provided with the control pin 55 already described in detail in connection with the first embodiment with reference to FIG. 13 for a pushing movement 39 or pushing movement 37' effected by the carrier 42 of the casement with respect to the window frame. In the embodiment according to FIG. 17 the extension rod 40 is connected to the second carrier 42 by means of a first quick release fastener 35 as already described in connection with the carrier 41 with reference to FIG. 3. This extension rod 40 has, according to FIG. 17 a further quick release fastener 35' of this type on its free end for connection with the closure rod which is not shown in FIG. 17. Of course, the closure rod could also be connected directly to the formerly described quick release fastener 35 of the second carrier 42.

The coupling shown in the second embodiment shown in FIGS. 17 to 22, of at least one pivotable hook 76 which cooperates with a trunnion 66 is useable with other types of window or door furniture, independently of the previously described device. Between two parts of a furnishing, moveable with respect to one another, which are selectively coupled or uncoupled from one another, this particular coupling could be used, for example, between a longitudinally displaceable connecting rod on the one hand, and a stationary striking plate on the other hand. It is particularly advantageous when, as in the previously described embodiment, two mirror-image, pivotable hooks 76, 76' are used for one of the coupling parts, which have the opposite facing hook-openings 73, 73' described. The two hooks 76, 76' are associated with a common trunnion 66, which when coupling, the two hooks have between them in a pincer-like manner, as shown already in FIG. 22. The particular embodiment shown and its application with respect to any other window or door furniture is of an independent inventive significance.

While the foregoing description and drawings represent the preferred embodiments of the present invention, it will be obvious to those skilled in the art that various changes and modifications may be made therein without departing from the true spirit and scope of the present invention.

What is claimed is:

1. A device for opening and closing a window or a door, having a stationary frame and a casement moveable between a closed and an open position with respect thereto, which is connected to the frame by at least one hinge part, said device comprising:

a toothed rack in the frame, longitudinally displaceable by a rotary operated drive pin;

a carrier means which is placed on the toothed rack for converting longitudinal displacement of said toothed rack into movement of the casement between its closed and open position by means of a connecting member;

at least one pair of mutually complementary closing elements between the casement and the frame, which acts to ensure the closed position of the casement and includes a moveable and a stationary closing element;

said moveable closing element for being changed-over between a latched position holding the casement against the frame and an unlatched position releasing the casement; wherein said carrier means includes a first carrier cooperating with the toothed rack and a second carrier which is connected to the moveable closing element, where both the first and second carriers are for moving the casement;

said second carrier for changing over said moveable closing element between its latching and unlatching positions;

said moveable closing element being arranged on the frame;

each of said two carriers being provided with at least one coupling means;

said toothed rack is provided with associated counter coupling means which are positioned at a longitudinal distance from one another on said tooth rack so that said toothed rack carries along one of said carriers when a coupling between the coupling means on one of said carriers and one of said counter coupling means on said toothed rack is effective; and, said coupling is associated with one of two change-over means which are located at two specific change-over locations on a path of longitudinal displacement of the toothed rack, where said change-over means automatically render the associated coupling effective or ineffective.

2. The device according to claim 1, wherein essentially only one coupling is effective at a time due to the arrangement of the two change-over locations on the path of longitudinal displacement of the toothed rack, while the other coupling is rendered ineffective.

3. The device according to claim 2, wherein, along the path of longitudinal displacement of the toothed rack, the areas with effective coupling of the two carriers overlap.

4. The device according to claim 1, wherein said toothed rack is received in a guide housing for its longitudinal displacement, and the two carriers are also guided parallel on the guide housing.

5. The device according to claim 1, wherein the change-over locations are arranged on two ends of a guide housing.

6. The device according to claim 1, wherein the coupling means is composed of an active coupling part which is coupled with a passive coupling part which composes said counter coupling means, wherein the active coupling part is seated on the carrier while the passive coupling part is located on the toothed rack and the active coupling part is uncoupled from the passive coupling part of the toothed rack when it enters the change-over means and is held at the change-over location, as a result of which the carrier is stationary at the change-over location, the passive coupling part located on the toothed rack being displaceable in the same direction past the change-over location; during return displacement of the toothed rack in the opposite direction, when the passive coupling part returns to the change-over location, the carrier is carried along and, upon leaving the change-over means, the active coupling part automatically couples again with the passive coupling part of the toothed rack.

7. The device according to claim 6, wherein passive counter coupling parts are arranged in two end regions of the toothed rack.

8. The device according to claim 1, wherein the coupling means located on the carrier includes a powered coupling pin which, although it has to drive into a coupling holder located on the toothed rack which forms the counter coupling means, is also lifted out of the coupling holder by the associated change-over means.

9. The device according to claim 8, wherein the toothed rack is provided with a further projection in addition to the coupling holder, which impacts with the coupling pin provided On said coupling means when the toothed rack is returned, and pushes it, together with the carrier out of the change-over means, whereupon the coupling pin then enters into the coupling holder.

10. The device according to claim 9, wherein the coupling pin is connected to the carrier by means of a leaf spring and the change-over means lifts the coupling pin out of the coupling holder when the leaf spring enters the change-over means, and lowers the coupling pin when the leaf spring leaves the change-over means.

11. The device according to claim 8, wherein the entry into and leaving of the coupling holder by the coupling pin is done by means of a forced guide, which is arranged on the change-over means.

12. The device according to claim 1, wherein the coupling means located on the carrier is composed of at least one pivotable hook with a hook-opening, the associated counter coupling means is a trunnion located on the toothed rack, and the hook is pivotable between two locations with respect to the trunnion, that is a closed location making the coupling effective where the hook opening clutches the trunnion and a braced location making the coupling ineffective where the hook-opening releases the trunnion.

13. The device according to claim 12, further comprising at least one guide surface which is arranged parallel to the longitudinal displacement of the toothed rack, on which the hook slides when the toothed rack is longitudinally displaced which keeps the hook in its closed location, making the coupling effective, where an end of the guide surface determines the change-over location and the hook is laid bare and is transferred by a bracing force into its braced position making the coupling ineffective.

14. The device according to claim 13, wherein the guide surface is a component of a guide housing which serves to longitudinally displace the toothed rack.

15. The device according to claim 14, wherein a bracing force for the hook is produced from a component of force which is transferred between the trunnion and the profiled hook opening during longitudinal displacement of the toothed rack.

16. The device according to claim 14, wherein the bracing force is produced by a spring integrated in the carrier, which presses the hook into its braced location.

17. The device according to claim 16, wherein the hook is formed by a first outer arm and a second inner arm and the spring force acts upon the second inner arm.

18. The device according to claim 17, wherein, although the spring force acts substantially parallel to the longitudinal displacement of the toothed rack, it presses on an end of the second inner lever arm by an inclined profile, and there produces a diagonally oriented bracing force.

19. The device according to claim 12, wherein a stationary stop limits the path of longitudinal displacement of the carrier at the change-over location.

20. The device according to claim 12, wherein an end position of the carrier on its change-over location is fixed in one direction by a stationary stop and in an opposite direction by a braced position of its hook, in which the hook is supported on an end of a guide surface.

21. The device according to claim 20, wherein the hook is provided with an undercut shoulder which in the braced position grips behind an edge on the end of the guide surface and stops the carrier in its end position.

22. The device according to claim 12, wherein the carrier has two mirror-identical pivotable hooks with hook openings facing towards each other to which a common trunnion is associated on the toothed rack, and the two hooks clasp the trunnion between them in a pincer-like manner when coupling is effected.

23. The device according to claim 22, further comprising two guide surfaces which keep the two hooks closed against each other in a pincer-like manner and a common spring for parting the two hooks from one another in a pincer-like manner.

24. The device according to claim 1, wherein between the second carrier and the moveable closing element at least one pair of radial cams is arranged, which when the casement moves serves to press the casement against, or push it away from the frame before reaching or after leaving the closed position.

25. The device according to claim 24, wherein the movable closing element includes a rod proceeding therefrom, and the pair of radial cams includes a control member which can be displaced along with the second carrier and a stationary opposing control member wherein the control member which can be displaced is arranged on the rod between the carrier and the closing elements and is composed of a control pin, while the stationary opposing control member is located on the casement and is composed of a control channel with profiled channel sides for receiving the control pin.

26. The device according to claim 1, wherein an axle of the drive pin is substantially perpendicular to the plane of the window frame and has a drive bolt protruding from the frame, and the drive bolt can be connected to a selectable drive mechanism comprising One of a crank handle and a drive motor by means of a plug-in connection.

27. The device according to claim 26, wherein the drive mechanism, such as the crank handle serves to move the casement between its open and closed position as well as to adjust the movable closing element located in the frame between the latching and unlatching positions.

28. The device according to claim 27, wherein the bolt protruding perpendicularly with respect to the plane of the frame is indirectly connected to the crank handle by means of a universal joint, which crank handle can be rotary operated in a plane which is inclined with respect to the plane of the frame of the window frame.

29. The device according to claim 28, wherein the universal joint is received in an angle housing and forms a pre-assembled component together therewith, which can be attached to the frame by fastening elements, such as screws, wherein the projecting drive bolt of the drive pin can be inserted in the frame-side end of the angle housing and is automatically torsion resistant with respect to the universal joint, whereas the drive mechanism, such as the crank handle, on an opposite free end of the housing can be connected to the universal joint.

* * * * *